US005744746A

United States Patent [19]

Tripptrap et al.

[11] Patent Number: 5,744,746

[45] Date of Patent: Apr. 28, 1998

[54] TANDEM WARHEAD FOR COMBATTING ACTIVE TARGETS

[75] Inventors: Peter Tripptrap, Langenfeld; Jörg Peters, Düsseldorf; Torsten Niemeyer, Hilden; Herbert Scholles, Hermannsburg, all of Germany

[73] Assignee: Rheinmetall GmbH, Dusseldorf, Germany

[21] Appl. No.: 566,819

[22] Filed: Jul. 12, 1990

[30] Foreign Application Priority Data

Jul. 20, 1989 [DE] Germany ..... 39 24 087.8

[51] Int. Cl.[6] ..... F42B 12/18; F42C 13/02

[52] U.S. Cl. ..... 102/476; 102/211; 102/213

[58] Field of Search ..... 102/211, 213, 102/308, 476; 244/3.21

[56] References Cited

FOREIGN PATENT DOCUMENTS 2633383 12/1989 France ..... 102/476

*Primary Examiner*—Harold J. Tudor

*Attorney, Agent, or Firm*—Spencer & Frank

[57] ABSTRACT

A tandem warhead for combatting actively armored targets including two shaped or projectile forming charges arranged one behind the other, and an ignition or firing delay unit which causes the ignition of the first charge and then the second charge with a time delay. To avoid the target's active armor plate (which moves when hit by the first charge, from impeding or even destroying the following charge) the tandem warhead is provided with a device for determining the actual angle of the warhead relative to the target, i.e., the firing or attack angle, and an ignition time delay $\Delta t$ associated with the respective firing angle $\alpha$. To determine the firing angle $\alpha$, an angle determining device includes a plurality, preferably four, distance measuring devices with which respective distance coordinates between the tandem warhead and the target are measured and used for determining the momentary firing angle $\alpha$. Thereafter, the delay time $\Delta t$ is determined with the aid of a characteristic curve $\Delta t=f(\alpha)$ which is specific for the particular warhead.

10 Claims, 10 Drawing Sheets

TANDEM WARHEAD FOR COMBATTING ACTIVE TARGETS

BACKGROUND OF THE INVENTION

The present invention relates to a tandem warhead for combatting active armored targets. More particularly the present invention relates to such a warhead which includes a first shaped or projectile forming leader charge disposed in a front portion of the warhead, a second shaped or projectile forming main charge disposed in the warhead behind the first charge when seen in the direction of flight of the warhead, and an ignition unit for causing the first charge to be ignited and thereafter the second charge to be ignited with a time delay.

Tandem warheads of the above-mentioned type are disclosed, for example, in Federal Republic of Germany DE-OS 3,619,791, corresponding to U.S. Pat. No. 4,848,238. Such a warhead is composed of two charges. The first charge (leader charge) serves the purpose of activating (i.e. destroying) at least one active module of the target to be combatted so that the second charge (main charge) now needs to penetrate only an inert target (tandem principle). The leader charge and the main charge are ignited sequentially via an ignition delay unit provided with a constant ignition delay between the two charges.

It has now been found that with a constant ignition delay, the combatting of active targets under certain angles leads to a reduction or even failure of the effect of the main charge in the inert target because the moving active target plates impede or even destroy the main charge and/or its active substance.

Thus, the effect of tandem warheads having a constant ignition delay is a function of the firing or attack angle.

Federal Republic of Germany Patent No. 3,141,333 already discloses an impact fuze for a projectile which penetrates the outer walls of targets and in which the impact angle is determined when the projectile hits in order to initiate a detonation in the interior of the target object within the most favorable distance range relative to the wall of the target object.

Federal Republic of Germany Patent No. 3,215,845 also discloses a proximity sensor operating according to the pulse duration method for use in shaped charge warheads.

SUMMARY OF THE INVENTION

It is an object of the present invention to further develop a warhead of the above-mentioned type so that the effect of the main charge is not impeded if the firing angle changes.

The above object is generally achieved according to the present invention by a tandem warhead for combatting active armored targets, which warhead includes a first shaped or projectile forming leader charge disposed in a front portion of the warhead, a second shaped or projectile forming main charge disposed in the warhead behind the first charge when seen in the direction of flight of the warhead, and ignition means for causing the first charge to be ignited and thereafter the second charge to be ignited with a time delay $\Delta t$; and wherein the tandem warhead further includes means for determining the momentary attack angle $\alpha$ of the warhead relative to the target and a time delay $\Delta t$ associated with the respectively determined momentary angle $\alpha$ and for supplying the determined time delay $\Delta t$ to the ignition means, with the means for determining including: a plurality of distance measuring means, disposed on the warhead, for providing measured respective distance coordinates between the tandem warhead and a target in the flight direction of the warhead; means for using the measured respective distance coordinates to determine the momentary angle $\alpha$; and means for providing a value corresponding to the time delay $\Delta t$ determined with the aid of a characteristic curve $\Delta t=f(\alpha)$ specific for the warhead.

According to the preferred embodiment of the invention four of the distance measuring means are disposed symmetrically adjacent an outer circumference of the warhead, and each distance measuring means is an optical measuring means. Preferably each distance measuring means is provided with its own transmitting and receiving unit, for example, a laser diode and a laser or light detector, respectively. However, if desired, the light to be transmitted by each of the distance measuring means may be provided by a single laser diode, a beam divider disposed between the laser diode for splitting the laser light into a number of light beams corresponding to the number of the distance measuring means, and means for conducting each of the light beams to a respective one of the distance measuring means for transmission.

According to a further feature of the invention the tandem warhead may be provided with a distance sensor, of the type generally provided in such warheads, for controlling the activation of the distance measuring means and/or for triggering the ignition means at a predetermined stand-off distance from a target. Moreover, if the projectile is of the type which includes a flight control system, then the flight control system can be made to respond to the momentary determined attack angle to change the direction of flight of the projectile until an optimum attack or firing angle results for the warhead.

The present invention is thus essentially based on the fact that the attack or firing angle is determined before the warhead hits the target and the ignition delay between firing of the leader charge and firing of the main charge is automatically set under consideration of this determined angle. By selecting the ignition delay in dependence on the attack angle, hitting of the main charge before it reaches the inert target (e.g.; inner plate) by parts of the target, particularly the active module, which fly about due to penetration of the leader charge, can be substantially avoided.

The invention will be described below in greater detail with reference to embodiments thereof and to the drawing figures.

BRIEF DESCRIPTION OF THE PREFERRED EMBODIMENTS

FIG. 1 schematically shows a tandem warhead according to the invention before hitting a target provided with active armor.

DETAILED DESCRIPTION OF THE PREFERRED EMBODIMENTS

Figure 1:
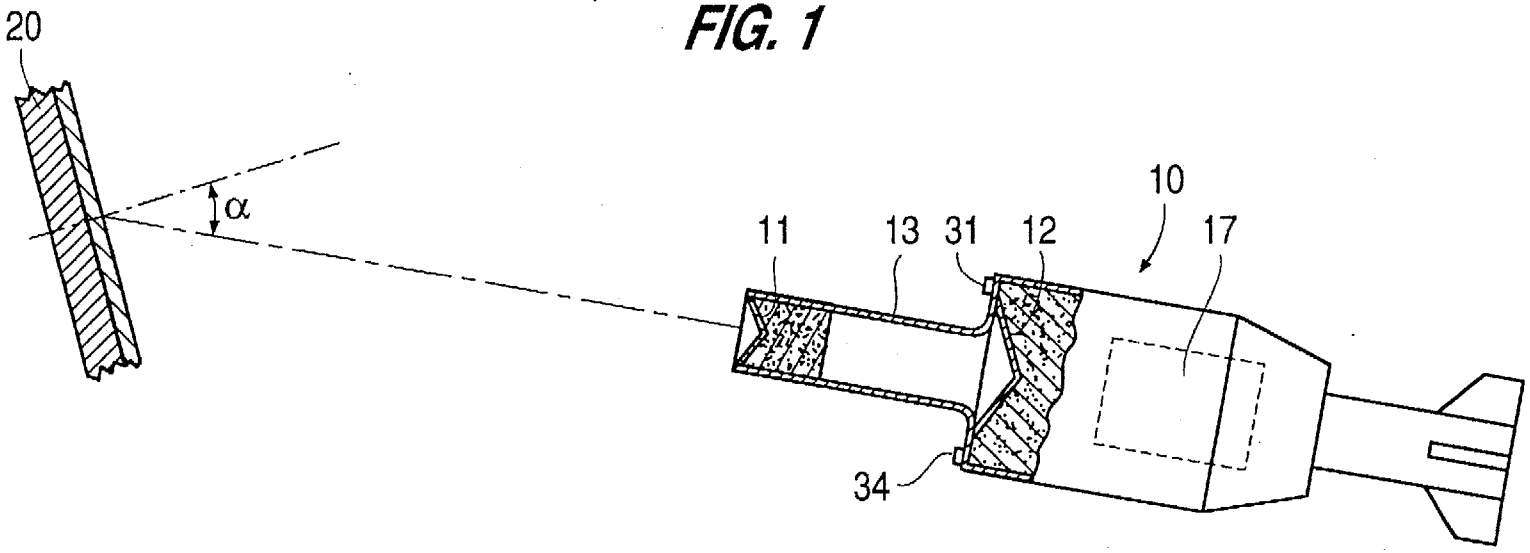

In FIG. 1, the reference numeral 10 identifies a tandem warhead and the reference numeral 20 part of an actively armored target. In a known manner, the tandem warhead 10 is composed essentially of a first shaped or projectile forming charge 11 (leader charge) and a second shaped or projectile forming charge 12 (main charge) with the respective charges 11 and 12 being disposed behind one another in the direction of flight of the warhead 10, and being sequentially ignited with an ignition delay Δt. In the illustrated embodiment, the tandem warhead 10 is a fin stabilized warhead wherein the leader charge 11 is mounted at the front of an axial tube 13 mounted on the front end of the housing for the main charge 12 in a known manner. In the vicinity of the outer circumference of the tandem warhead 10 a plurality of distance measuring devices, are disposed. Preferably, as shown, four distance measuring devices 31 to 34, only two of which, i.e., distance measuring devices 31 and 34, are visible in FIG. 1, are provided and symmetrically disposed in the vicinity of the warhead outer circumference. These distance measuring devices 31–34 are arranged on the tandem warhead 10 in such a manner that they are able to measure the distance of the warhead from targets 20 in the direction of flight. Distance measuring devices 31 to 34 are preferably optical devices which are each essentially composed of a transmitter and a receiver, preferably a laser diode and a laser detector, respectively.

In the interior of the warhead 10 there is disposed a device 17 which, in response to received signals, causes the sequential ignition of the charges 11 and 12 with a time delay Δt. According to the present invention the device 17 is responsive to the signals from the distance measuring units 31–34 to determine the firing or attack angle α, i.e., the angle between the longitudinal axis of the projectile and a line perpendicular to the surface of the target, and the ignition delay Δt corresponding to the determined angle α for the specific warhead 10. The specific functions and structure of the device 17 will be described in greater detail below.

Figure 2:
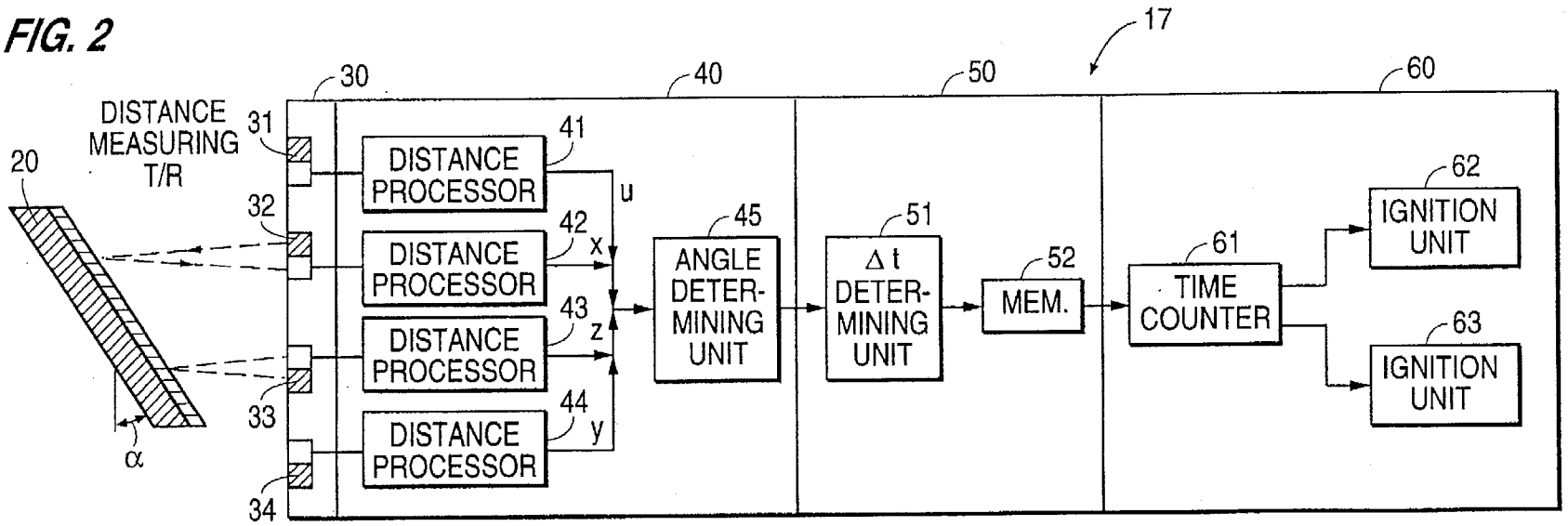
FIGS. 2 to 6 are block circuit diagrams of various embodiments according to the invention for determining the ignition delay.

FIG. 2 is a block diagram for device 17, for controlling the ignition of the charges. In FIG. 2, as in the succeeding figures, the reference numeral 30 identifies the distance measuring unit, the numeral 40 identifies a signal processing unit, the numeral 50 identifies a unit for processing warhead characteristics, and the numeral 60 identifies a time control and ignition unit.

The distance measuring unit 30 is essentially composed of the above-mentioned distance measuring devices 31 to 34. The outputs of these distance measuring devices 31 to 34 are connected to respective devices for determining respective distance coordinates x, y, z and u. The respective devices for determining distance coordinates are associated with the signal processing unit 40 and are identified by reference numerals 41 to 44. The respective outputs of devices 41 to 44 are connected with a device 45 for calculating the attack angle α. The output signal of device 45 is fed to unit 50 for processing the characteristics. This unit is essentially composed of a unit 51 which determines the delay time Δt from the relationship $\Delta t = f(\alpha)$, and a memory 52 in which the determined ignition delay time is stored. The unit 51 may be, for example, a processor which calculates Δt from the indicated relationship, or a read-only memory (RAM) in the form of a look-up table in which precalculated values of Δt are stored at respective addresses which are addressed by the output signal of device 45.

f (α) is a characteristic specific for the design of the particular warhead 10 and characterizes the relationship between the firing delay Δt of the main charge 12 relative to the leader charge 11 and the attack angle α. However, additional functions may also be processed or taken into consideration by unit 51, such as, for example, the firing delay as a function of the size of the active target or as a function of the thickness and velocity of the active target plate or as a function of the physical characteristics of the active foil or plate (e.g. sensitivity, detonation velocity, etc.).

The output of memory 52 is connected with the input of the time control unit 60 which in turn includes a time counter 61 as well as ignition devices 62 and 63 for igniting the leader charge 11 and the main charge 12, respectively.

Figure 3:
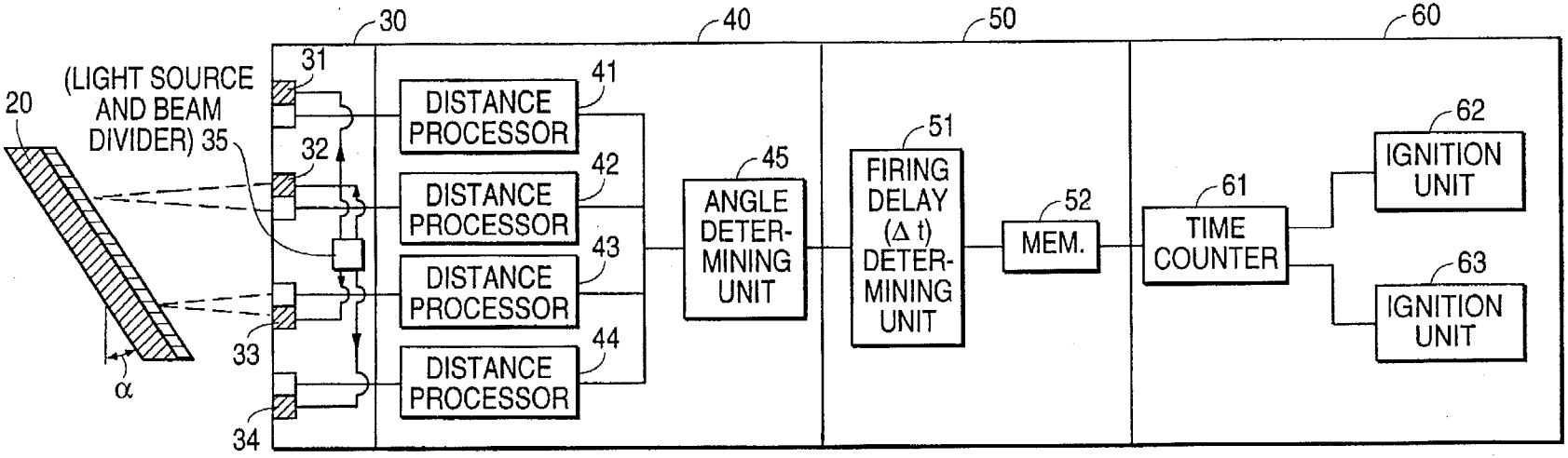

FIG. 3 shows a modification of the arrangement of FIG. 2 in which only a single light source 35 is employed to produce the light transmitted by the four distance measuring devices 31–34. According to this embodiment, the light source 35 is, for example, a single laser diode and a beam divider which optically divides the light from the laser diode into four equivalent light beams. These four light beams are then conducted, for example, via respective optical fibers, to the respective distance measuring devices or sensors 31, 32, 33 and 34 for transmission. The laser detectors of the four distance sensors 31–34 then receive the light reflected from the target as input signals and conduct the corresponding electrical signal to the devices 41–44 of the signal processing unit 40.

Figure 4:
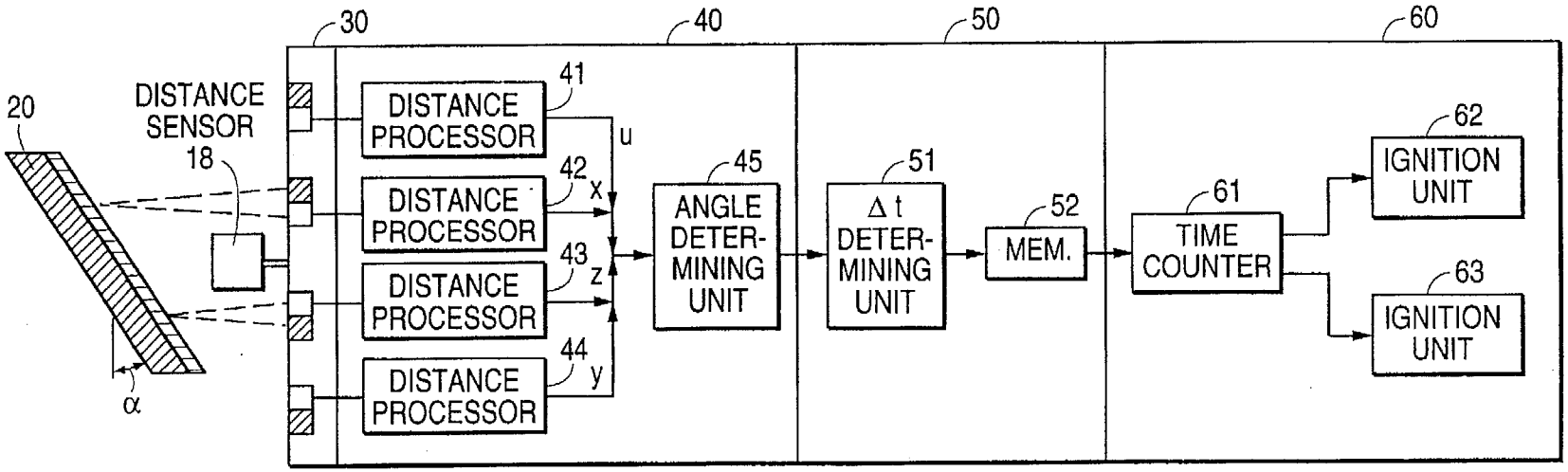

FIG. 4 differs from FIG. 2 essentially only in that a conventional distance sensor 18, of the type generally provided in such tandem warheads to initiate ignition, is additionally provided and which, after detection of a target, activates device 17. Then, shortly before the moment of optimum stand-off or distance, the momentary distances from the target are determined with the aid of distance measuring devices 31 to 34 and the devices 41 to 44 connected to their outputs. The subsequently connected device 45 then determines, e.g. by calculation, the attack or firing angle α from the coordinate values provided by the devices 31–34. After determination of the angle α, the signals are further processed in unit 51. As already mentioned above, this unit 51 has a characteristic that is defined for the specific warhead 10 and characterizes the ignition delay Δt as a function of the momentary attack angle α. Thus, for each attack angle a there exists a defined firing delay Δt so that the primary charge 12 is able to produce the optimum effect in the inert target without being interfered with by the active armor.

The determined ignition delay Δt is stored in memory 52 and, in the region of optimum stand-off (as determined in the conventional manner by the distance sensor 18), is transmitted to the time counter 61. This triggers the ignition of the leader charge 12 via unit 62 and, after the above defined ignition delay Δt, the ignition of main charge 12 via the unit 63.

Figure 5:
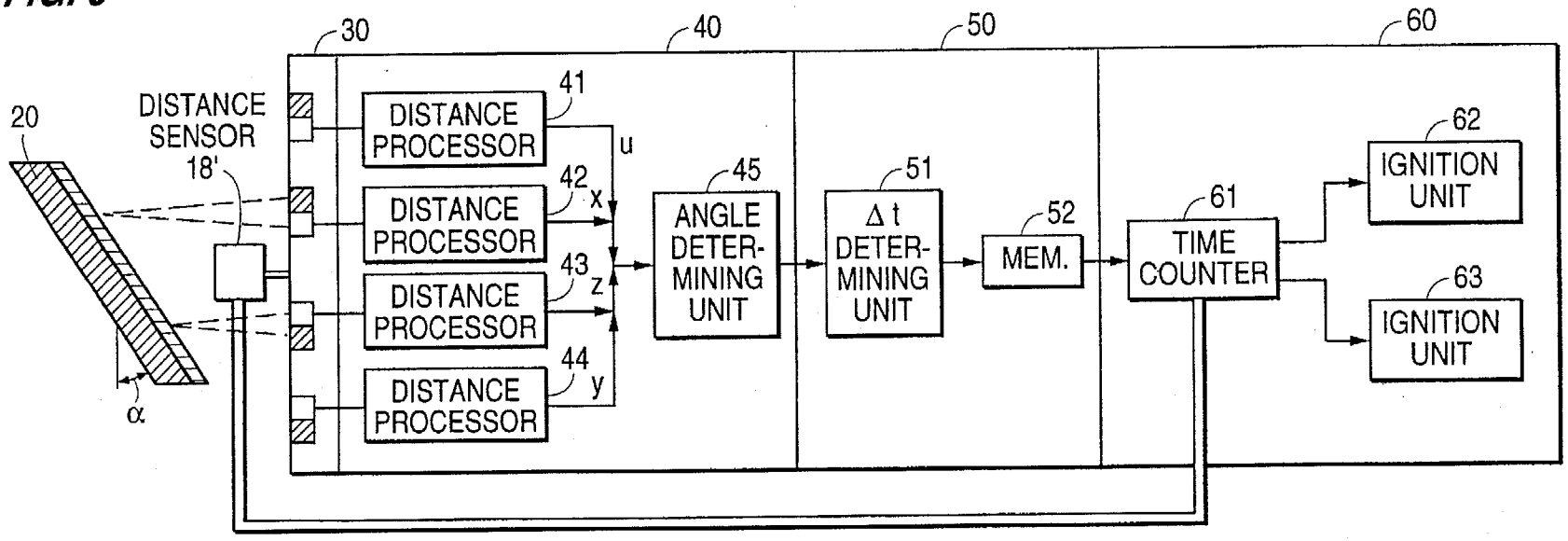
Figure 6:
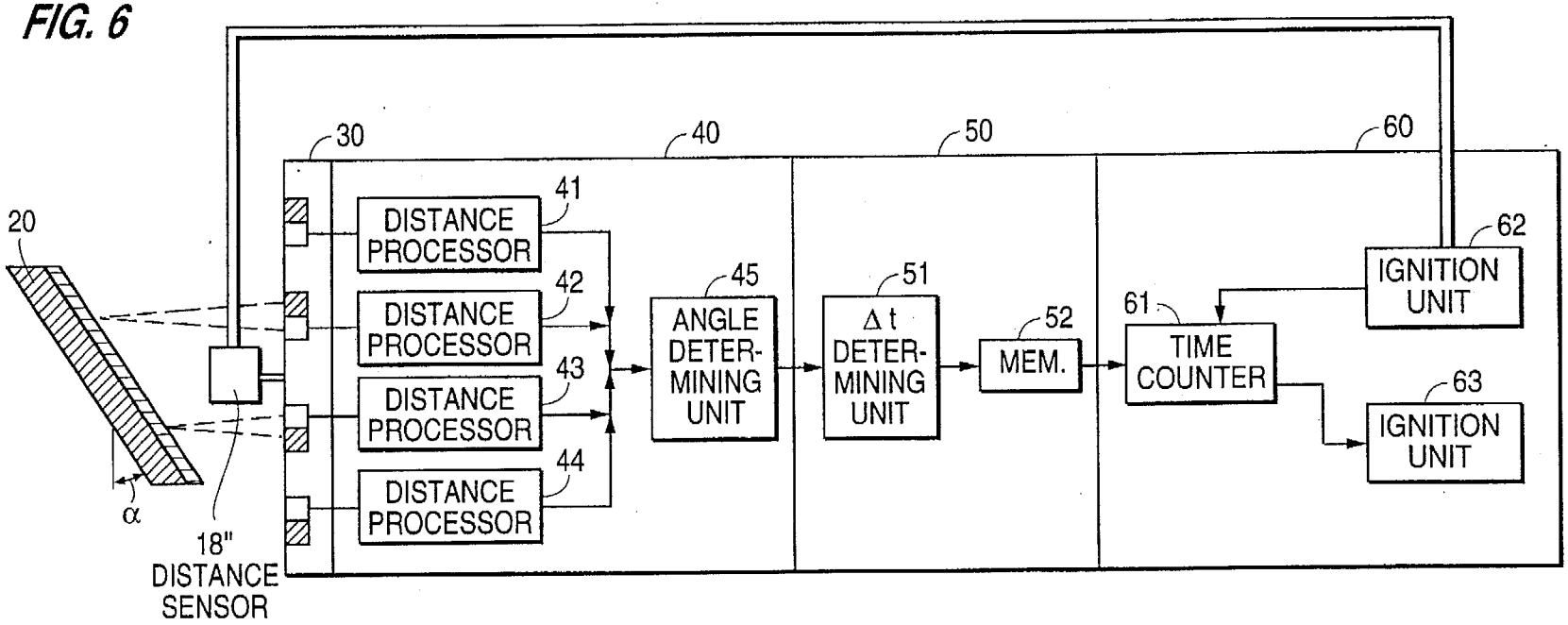

FIGS. 5 and 6 differ from FIG. 4 in that distance sensor 18 triggers the distance measuring unit 30 at time $t_0$ to begin measuring and triggers the ignition unit 62 for leader charge 11 at optimum standoff time $t_1$. In FIG. 5, the distance sensor 18' triggers the ignition unit 62 via the time counter 61. At time $t_1+\Delta t$, time counter 61 then conducts an ignition signal to the ignition unit 63 for the main charge 12.

In the embodiment shown in FIG. 6, the distance sensor 18" again triggers the distance measuring unit 30 at time $t_o$ and the ignition unit 62 for the leader charge 12 at time $t_1$. However, in this embodiment the sensor 18 directly triggers the ignition unit 62 which, when activated, puts out a signal for the time counter 61 containing the value Δt and causes it to begin counting down. At time $t_1+\Delta t$, the time counter 61 then provides an output signal to ignition unit 63 so that the main charge 12 is detonated at that time.

Of course, the distance sensors 18, 18' and 18" may also be absent entirely in the above-described embodiments of FIGS. 4–6. Then one of distance measuring devices 31 to 34 takes over the function of the distance sensor.

Figure 7:
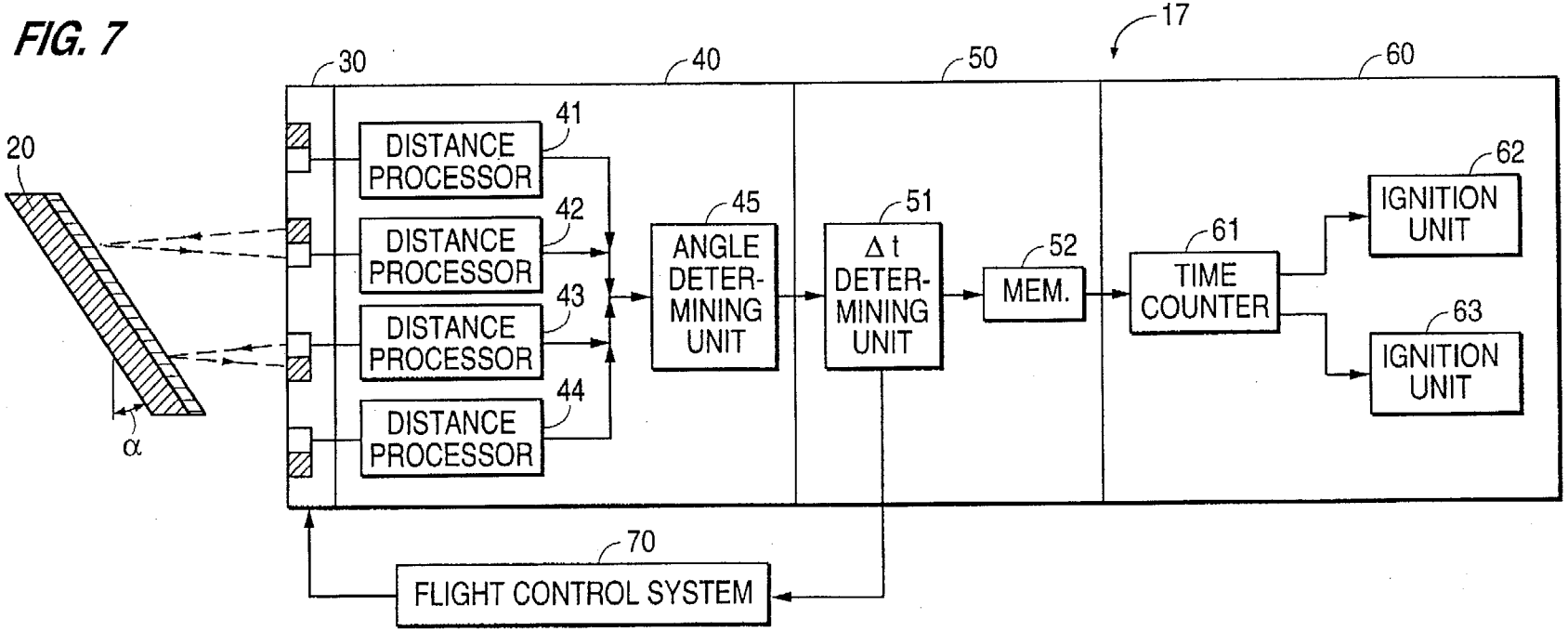
FIG. 7 is a block circuit diagram for guided ammunition in which signals are generated, according to the invention, for the ignition delay as well as for flight control.

As shown in FIG. 7, the device 17 may also be used for flight controlling purposes. To accomplish this, a return loop is included from the characteristic module 51 to the missile flight control system 70 and from there to the distance measuring unit 30.

If now, distance measuring unit 30 and device 45 determine, via characteristics module 51, that an unfavorable attack or firing angle α for the warhead 10 exists, module 51 transmits a signal to the missile flight control system 70 to change the flight direction and correct the angle. Once the approach angle has been corrected by the flight control system 70, the momentary attack or firing angle α is again determined with the aid of the distance measuring unit 30 and signal processing unit 40 and is monitored in characteristics module 51.

If an attack or firing angle α is determined which is the optimum for the warhead 10, the ignition delay Δt for this optimum angle is determined by way of characteristics module 51 and the corresponding signals are transmitted via memory 52 and time counter 61 to ignition units 62 and 63.

The determination of the firing angle α with the aid of device 45 will now be discussed in greater detail. In this connection, it must be considered that with a rotating warhead 10, the four distance measuring units 31 to 34 may take on different positions shortly before reaching the optimum stand-off distance for the warhead.

Figure 8:
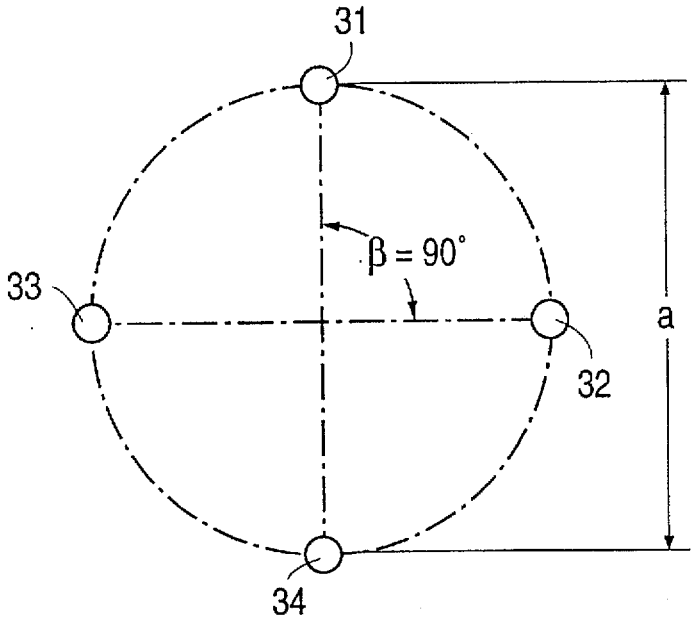
FIGS. 8 to 17 are various schematic front and side views of the distance measuring devices in the warhead in order to explain the operation of the invention under different firing angles.
Figure 9:
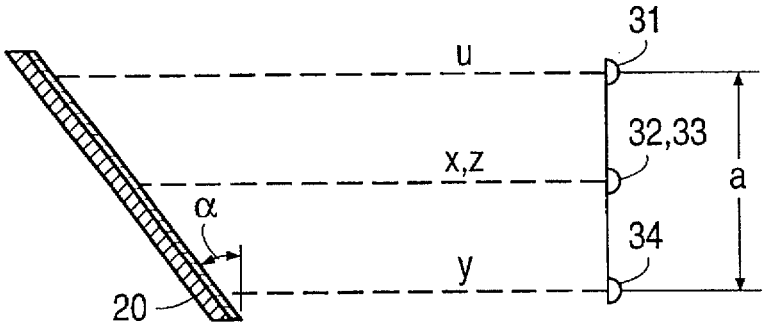

Case 1 (FIGS. 8 and 9)

For this case, the distance coordinates x, y, u and z determined by the measuring devices 32, 33, 31 and 34 respectively, have the following relative values:

x=z or u=y.

The following then applies for the angle α:

$$\alpha = \arctan\frac{u-y}{a}$$

or $$\alpha = \arctan\frac{z-x}{a}$$

where a is the distance between two oppositely disposed distance measuring devices, e.g. 31 and 34 or 32 and 33.

Figure 10:
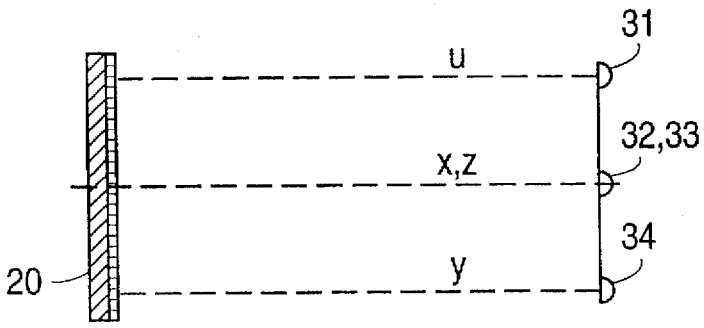

Case 2 (FIGS. 8 and 10)

In this case, as shown in FIG. 10, the relationship between the measured distance coordinates is:

x=y=z=u

In this special case, an ignition delay Δt as previously defined by characteristics module 51 is stored in memory 52. This ignition delay is a permanent feature of characteristics module 51.

Figure 11:
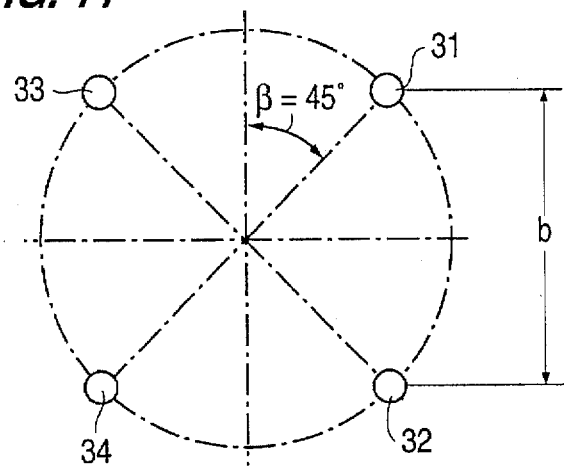
Figure 12:
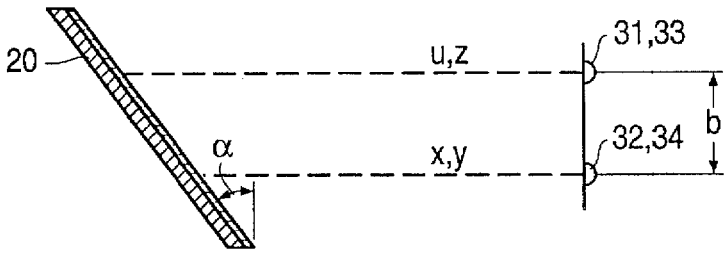
Figure 13:
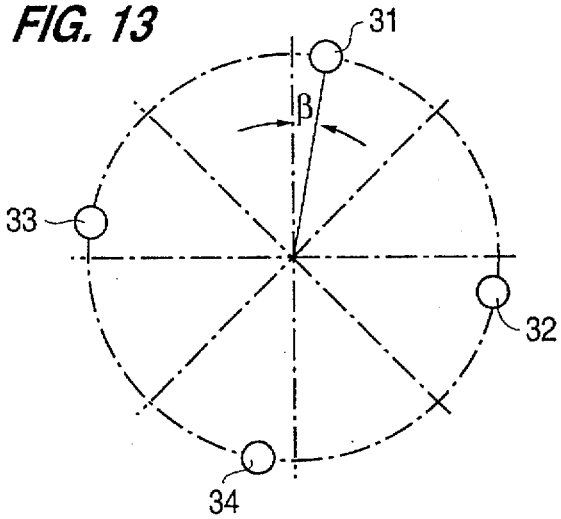

Case 3 (FIGS. 11 and 12)

As shown in these figures the relationship between the measuring distance coordinates is now:

u=z and x=y.

The following applies:

$$\alpha = \arctan\frac{u-x}{b}$$

-continued or $$\alpha = \arctan\frac{u-y}{b}$$

or $$\alpha = \arctan\frac{z-x}{b}$$

or $$\alpha = \arctan\frac{z-y}{b}$$

Here b is the distance between two adjacent distance measuring devices 31–34 and the following applies:

$$b = -\sqrt{\frac{1}{2}} \cdot a$$

Case 4 (FIGS. 13 to 17)

The relationship between the measured distance coordinates is:

x≠y≠z≠u

Figure 14:
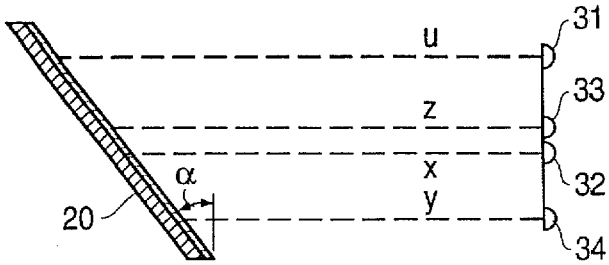

With the configuration shown, for example, in FIG. 14, the following results:

u=maximum path or distance y=minimum path or distance

Here, as in Case 1, the angle is defined by $$\alpha = \arctan\frac{u-y}{a}$$

However, in contrast to Case 1, an error occurs here in the determination of the angle by way of the distance measurement. That is, the actually existing angle is greater than the calculated angle.

To estimate the maximum occurring angle, the following most unfavorable case is considered:

1. the target is being attacked at an angle a=45° NW;
2. the distance measuring devices enclose an angle β=22.5°.

Figure 15:
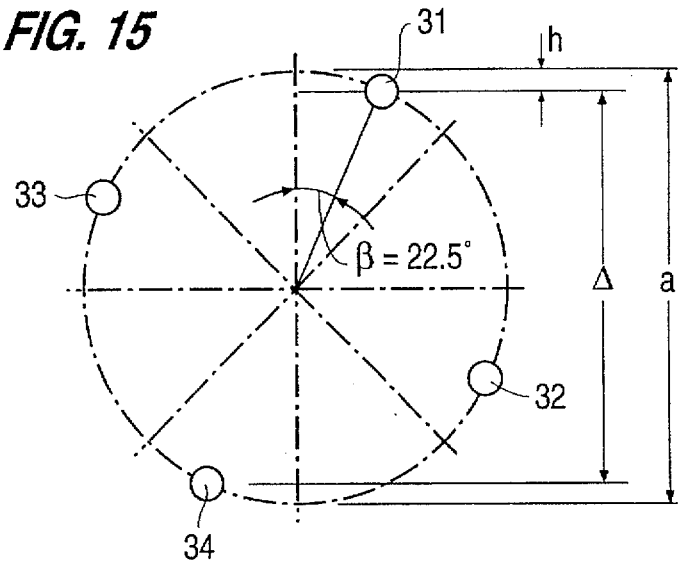
Figure 16:
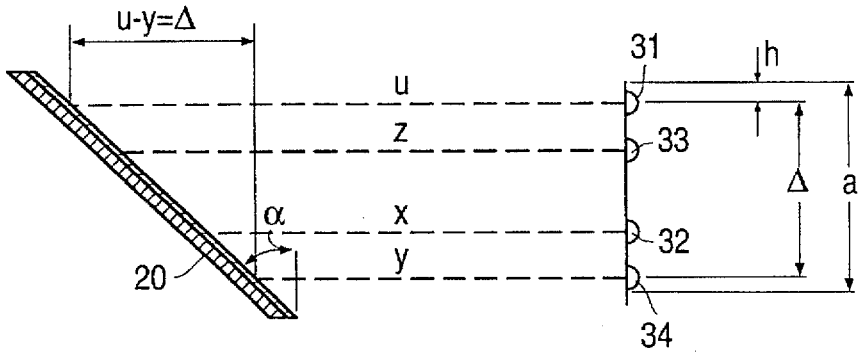
Figure 17:
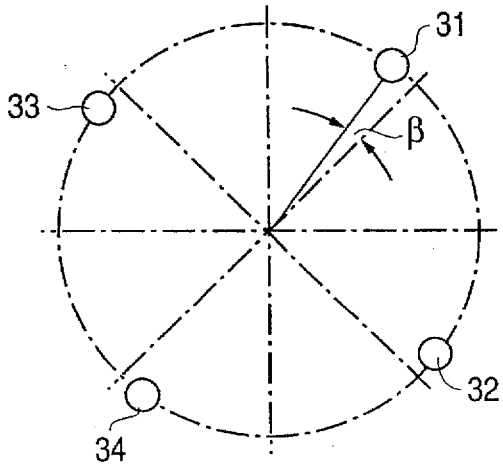

Then, according to FIG. 15, the following applies:

$$\cos 22.5° = \frac{a/2-h}{a/2}\ ;\ \text{from which } h = \frac{a}{2}\cdot(1-\cos 22.5°),$$

and $$h = 0.0381 \cdot a.$$

Since this error occurs at u and at y, the following applies:

$$j = 2\cdot h = 0.076\ a$$

With α=45°, the path difference measured compared to Case 1 is $$\Delta = a - 0.0761\ a, \text{ or}$$

$$\Delta = 0.924\ a$$

The calculation for a target inclined at α=45° (FIG. 16) is made as follows:

$$\alpha = \arctan \frac{u-y}{a}$$

$$\alpha = \arctan \frac{0.924\,a}{a} = \arctan 0.924$$

$$\alpha = 42.74°$$

The calculated value for the target inclination differs from the actual value by $$\Delta\alpha = 2.26°$$

The maximum possible error $f_{path}$ occurring during the path determination is $$f_{path} = 8\%$$

The maximum possible error $f_\alpha$ during the angle calculation is $$f_\alpha = 5\%$$

Compared to the errors in the total "warhead" system, the error $f_\alpha$ is negligibly small.

If, for example, the case occurs (FIG. 17) that u=maximum path y=minimum path the angle in Case 3 is determined by $$\alpha = \arctan \frac{u-y}{b}$$

Here again the maximum possible error in the angle calculation f is $$f_\alpha = 5\%.$$

The invention now being fully described, it will be apparent to one of ordinary skill in the art that any changes and modifications can be made thereto without departing from the spirit or scope of the invention as set forth herein.

What is claimed is:

1. In a tandem warhead for combatting active armored targets, said warhead including a first shaped or projectile forming leader charge disposed in said warhead in a front portion of said warhead, a second shaped or projectile forming main charge disposed in said warhead behind said first charge when seen in the direction of flight of said warhead, and ignition means for causing said first charge to be ignited and thereafter said second charge to be ignited with a time delay Δt; the improvement wherein said tandem warhead further includes means for determining the actual momentary attack angle α of the warhead relative to the target and a said time delay Δt associated with the respectively determined said momentary angle, and for supplying the said determined time delay Δt to said ignition means, with said means for determining including a plurality of distance measuring means, disposed on said warhead, for providing measured respective distance coordinates between said tandem warhead and a target in the flight direction of said warhead; means for using said measured respective distance coordinates to determine the momentary angle α; and means for providing a value corresponding to said time delay Δt determined with the aid of a characteristic curve Δt=f (α) specific for said warhead.

2. A tandem warhead as defined in claim 1 wherein four of said distance measuring means are disposed symmetrically adjacent an outer circumference of said warhead.

3. A tandem warhead as defined in claim 1, wherein each said distance measuring means is provided with its own transmitting and receiving unit.

4. A tandem warhead as defined in claim 1 wherein each said distance measuring means is an optical measuring means.

5. A tandem warhead as defined in claim 4 wherein each said transmitting unit includes a respective active means for producing light to be transmitted.

6. A tandem warhead as defined in claim 5 wherein each said means for producing light is a laser diode.

7. A tandem warhead as defined in claim 4, wherein light to be transmitted by each of said distance measuring means is provided by a single laser diode, a beam divider disposed between said laser diode for splitting light emitted by said laser diode into a number of light beams corresponding to the number of said distance measuring means, and means for conducting each of said light beams to a respective one of said distance measuring means for transmission; and wherein each of said distance measuring means has its own respective light receiving unit.

8. A tandem warhead as defined in claim 1, further comprising a distance sensor means, provided in addition to said distance measuring means, for controlling the activation of said means for determining.

9. A tandem warhead as defined in claim 8, wherein said distance sensor means triggers said ignition means at a predetermined stand-off distance from a target.

10. A tandem warhead as defined in claim 1, wherein said tandem warhead further includes a flight control means for changing the direction of flight of said warhead as a function of the respectively determined attack angle until an optimum attack angle results for said warhead.

* * * * *